US006024359A

United States Patent [19]

Hutson

[11] Patent Number: 6,024,359

[45] **Date of Patent: *Feb. 15, 2000**

[54] SHEET STACKING TECHNIQUES

[75] Inventor: Sammy C. Hutson, West Bloomfield, Mich.

[73] Assignee: Unisys Corp, Blue Bell, Pa.

[ * ] Notice: This patent is subject to a terminal disclaimer.

[21] Appl. No.: 08/831,655

[22] Filed: Apr. 9, 1997

Related U.S. Application Data

[62] Division of application No. 08/653,783, May 28, 1996, Pat. No. 5,618,038, which is a division of application No. 08/451,801, May 26, 1995, Pat. No. 5,522,589, which is a division of application No. 08/212,093, Mar. 10, 1994, Pat. No. 5,419,545.

[51] Int. Cl.[7] ..... B65H 39/10

[52] U.S. Cl. ..... 271/297; 271/305; 271/220; 271/222

[58] Field of Search ..... 271/297, 305, 271/207, 222, 220, 202

[56] References Cited

U.S. PATENT DOCUMENTS

| | | | |
|---|---|---|---|
| 2,991,999 | 7/1961 | Doerner | 271/220 |
| 3,087,724 | 4/1963 | Snowdon et al. | 271/220 X |
| 3,137,499 | 6/1964 | Maidment | 271/305 X |
| 5,419,545 | 5/1995 | Hutson | 271/220 X |
| 5,522,589 | 6/1996 | Hutson | 271/220 X |
| 5,618,038 | 4/1997 | Hutson | 271/220 X |

*Primary Examiner*—David H. Bollinger
*Attorney, Agent, or Firm*—John McCormack; M. Stevy

[57] ABSTRACT

A document processing arrangement transporting sheets at a prescribed nominal speed along a track, terminated by sort-pockets, each with an associated diverter plus a guide assembly for guiding and driving a so diverted sheet into its pocket, the guide comprising an inject roll to accelerate the sheet, plus an arm assembly coupled to rotate with the roll and including an arm for guiding a so injected sheet toward its position in the pocket stack; this roll and arm assembly being arranged to rotate the arm away from its stack each time a sheet is entering, and also to be spring-driven to return the arm toward its stack.

28 Claims, 6 Drawing Sheets

SHEET STACKING TECHNIQUES

This is a Division of U.S. Ser. No. 08/653,783, filed May 28, 1996, now U.S. Pat. No. 5,618,038 which is a Division of Ser. No. 08/451,801 filed May 26, 1995, now U.S. Pat. No. 5,522,589 which, inturn, is a Division of Ser. No. 08/212,093, filed Mar. 10, 1994, now U.S. Pat. No. 5,419, 545.

This invention relates to document transport, sorting, and stacking equipment, and especially to an assembly for stacking documents in a sort pocket.

BACKGROUND, FEATURES

Workers are aware that present-day high speed document sorting arrangements are under scrutiny to solve problems that seem to persist; for example their rather high noise level and their many complicated expensive parts. This is certainly the case when stacking documents in a sort-pocket at a "high" rate (e.g. several hundred checks per minute or faster).

BACKGROUND, FEATURES

Workers in the field of high-speed document sort/processing, such as in the sorting of bank checks and like financial instruments, know that the art requires the use of machines and systems capable of moving and processing very large volumes of documents at up to thousands of documents per minute, while performing multiple and interrelated operations as the document are transported. Such operations can include, (but are not limited to), printing upon the documents, reading data previously encoded thereon by a variety of processes, recording an archival image of the document by photographic or electronic-imaging techniques, and other processes.

Workers understand that, when sorting such large volumes it is vital that an individual document be diverted and stacked in a sort-pocket as simply and quietly as possible.

This invention addresses these and related problems; e.g., teaching a sort-pocket with inject means coupled to guide-arm means wherein these means are conjunctively rotated towards a "full-pocket position" as each document enters their pocket, then released to be spring-urged and let the arm means resiliently depress the top document.

This invention teaches a novel sort-pocket stacking assembly that reduces noise, complexity and cost, while automatically aiming documents to the "top" of a stack in a sort-pocket.

This invention minimizes the cited shortcomings and includes a stacker assembly that can:

- accommodate high-capacity pockets, yet in a small footprint.
- handle a wide variety of document-lengths (e.g., checks 4.50–9.25");
- reduce number of parts, cost and noise by not using an "auger system" or "pull-in rollers" (with associated belts, etc.) to push the document stack aside;
- immediately position a document at, or close to, its final resting position in the pocket—by differently-aiming each incoming document toward its desired position (rather than by directing every document to a common pocket position and then moving it aside to make room for the next document); and
- allow an operator to tune the assembly to various document types; e.g. by adjusting return spring (e.g. for documents which are "abnormal", e.g. as to weight, height-aspect ratio or "grain": note recycled paper has no grain and reacts very differently).

As a feature hereof, such a sort-pocket stacker is preferably provided by coupling a guide-in arm assembly to inject roller means whereby the roller means automatically throws the assembly towards a full-pocket position as it injects a document and then lets it fall to the top of the stack—whereat the incoming document is aimed.

Thus, it is an object hereof to address (at least some of) the aforementioned problems, and to provide the hereincited advantages and functions. A related object is to provide such an automatic, "variable-aiming" stacker for a sort-pocket.

The methods and means discussed herein, will generally be understood as constructed and operating as presently known in the art, except where otherwise specified; with all materials, methods and devices and apparatus herein understood as implemented by known expedients according to present good practice.

BRIEF DESCRIPTION OF THE DRAWINGS

These and other features of advantage of the present invention will be appreciated by workers as they become better understood by reference to the following detailed descriptions of past and present preferred embodiments which should be considered in conjunction with the accompanying drawings, wherein like reference symbols denote like elements.

PREFERRED EMBODIMENT

Figure 1:
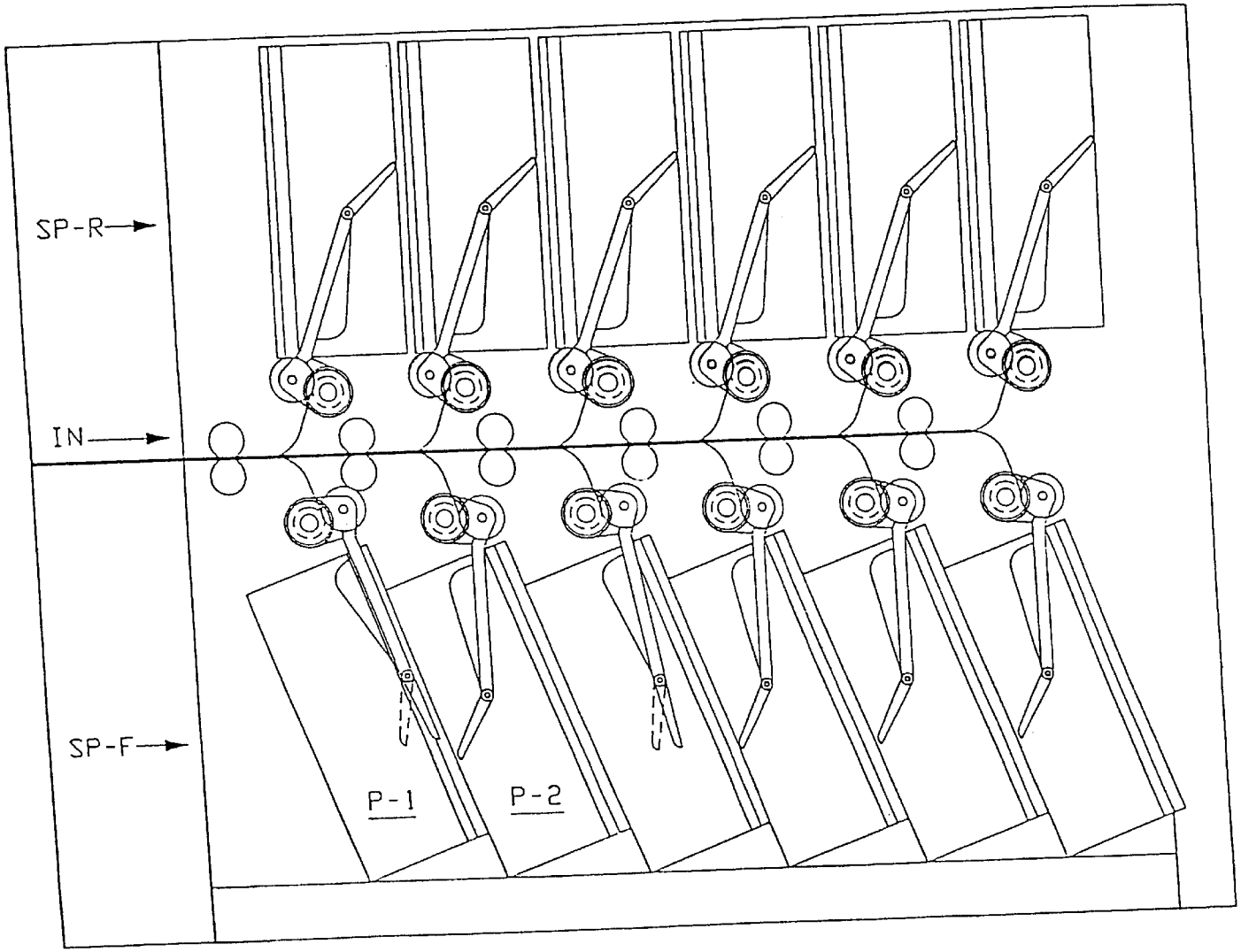
FIG. 1 is a simplified plan view of an array of sort pockets, each with a inject-reaction guide (arm) assembly according to a preferred embodiment.
Figure 2:
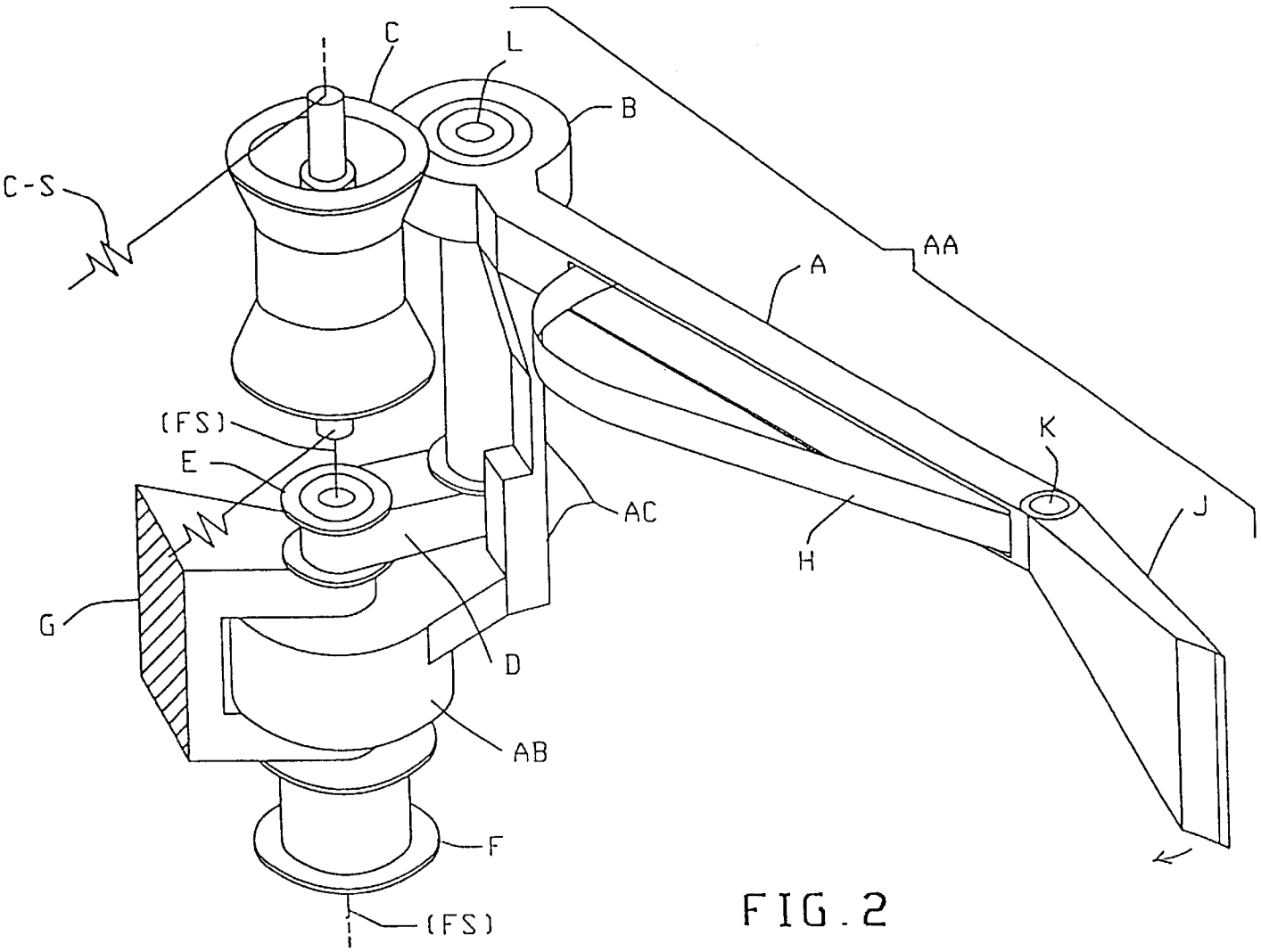
FIG. 2 is a very schematic isometric view of such a preferred stacker embodiment.

FIG. 1 may be understood as depicting in schematic plan view, an array of sort pockets (six rear pockets SP-R; six front-pockets SP-F) integrated into a high-speed check processing machine (e.g. at the end of check transport/processing track, with checks injected at IN, to be selectively diverted to an assigned sort-pocket (e.g. P-1) under control of a pocket-diverter unit (not shown, but well known in the art).

FIGS. 2–5 depict a preferred embodiment: a novel stacker assembly, generally comprising an "inject-reaction-guide" (arm) assembly AA (comprising an arm A, with tip J, integral with and supported on arm-block AB), together with a cooperating stack-inject-drive roller B plus associated stack-pulley E and belt D for driving roller B, along with main drive pulley F and housing/support-block G for rotating driver-pulley E, plus idler-roller C cooperating with inject roller B to engage, and drive-in entering documents.

Arm "A" is loaded clockwise (see plan view, FIGS. 1, 5) by an operator adjustable spring A-S adapted to urge tip J down atop the stack. Spring A-S is mounted on bearings on the shaft FS (FIGS. 3, 4C) for drive pulley "F". Pulley F is bearing-mounted to rotate in "turn-guide" housing "G". The centerline of drive pulley "F" is in line with "columnating" -idler "C" which is independently rotatingly-mounted and is spring loaded against pocket-inject drive roller "B" (e.g. see spring C-S, FIG. 3). Roller "B" is bearing-mounted on a shaft "L", which is mounted on block AB (in bearing therein; see (FIGS. 2–4) and is driven by a belt "D" which is, in turn, driven by pulley "E" coupled drivenly on shaft FS (for drive pulley "F").

Thus, on main shaft FS, pulley F is affixed to rotate shaft FS; and drive pulley E is affixed on FS to be rotated thereby, and to thereby rotate roller B in synchronism with FS [except that, pulley E and gearing for roller B, are dimensioned to cause B to rotate faster than (e.g. 1.3x) the rotational velocity of shaft FS).

Roller B is mounted to rotate freely (in bearings) on a shaft L affixed on (e.g., lead-screw into) block AB. Arm A is projected from a pillar extension AC which, in turn, projects up from block AB. Roller "B" is bearing mounted on shaft "L" (mounted on blocks AB, AC, see FIG. 3) and is driven by belt "D" (which in turn is driven by pulley "E", mounted on the end of shaft FS).

Block AB is mounted on main shaft FS to rotate freely thereon, being loosely captured (positioned) between the upper/lower arms of housing/support block G. Preferably, block AB includes extension AC (e.g. FIG. 3A) and is molded to integrate AC and arm A in a single unit. Return spring A-S urges this unit so arm A is urged down-into its pocket versus the documents therein. (e.g. see arrow FIG. 4C). Block G is affixed to the machine frame and locates shaft FS to allow free rotation of FS, while positioning-block AB including AC and arm A thereof, so that arm A is normally disposed to sweep documents across the floor of its respective sort pocket (see below), and so that inject-roller B is positioned to receive documents diverted to that pocket as known in the art (divert means not shown, but well known in the art).

Figure 3:
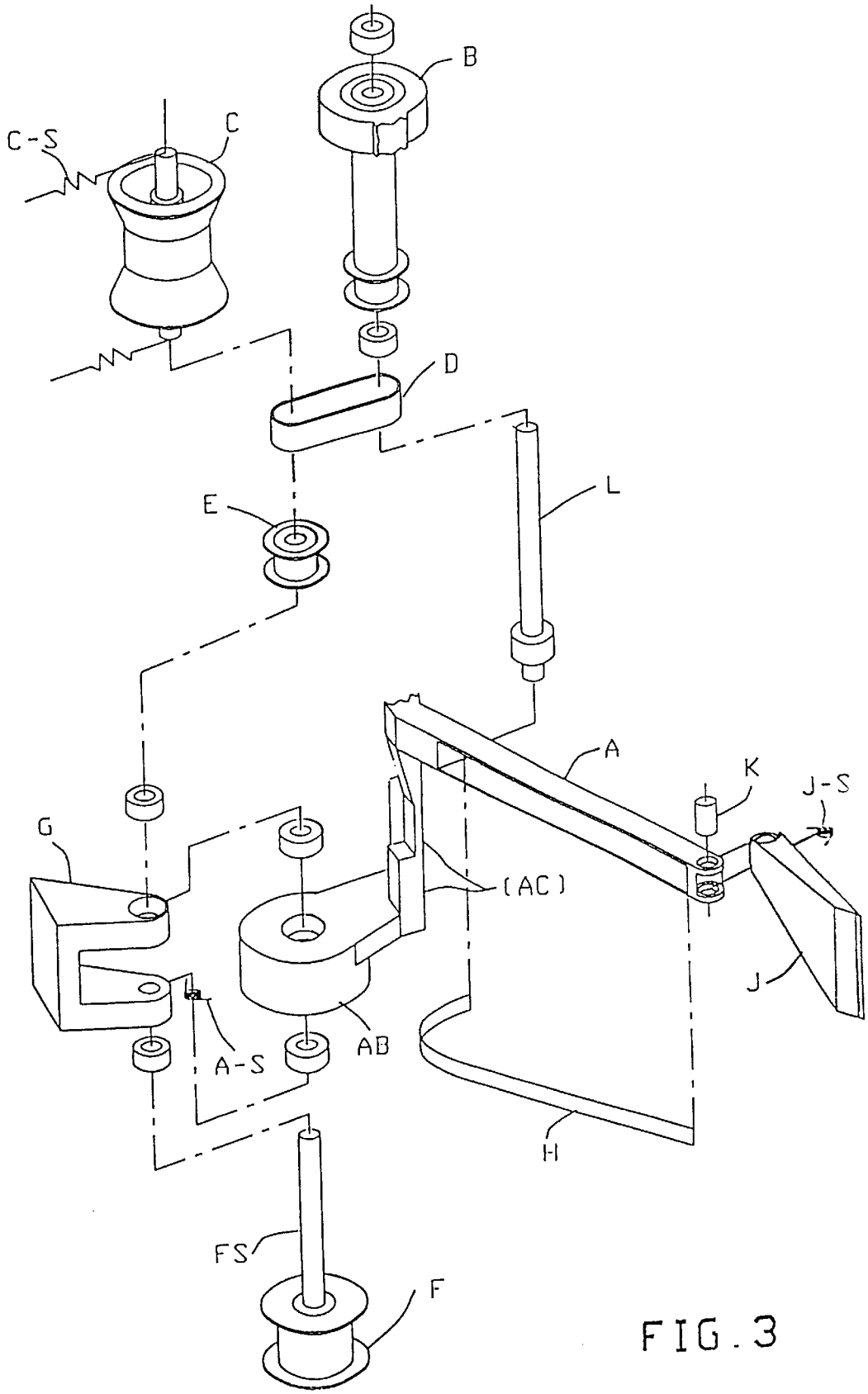
FIG. 3 is an exploded view of elements of FIG. 2; with FIG. 3A showing elements thereof.
Figure 4C:
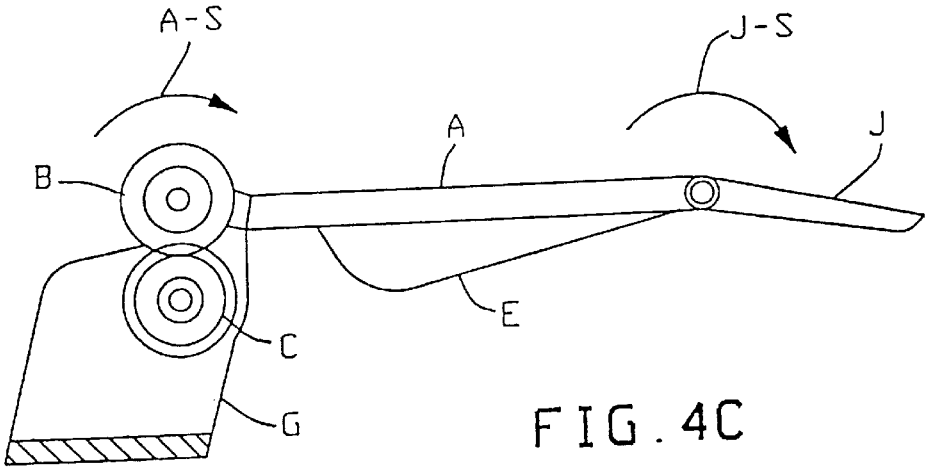
Figure 4D:
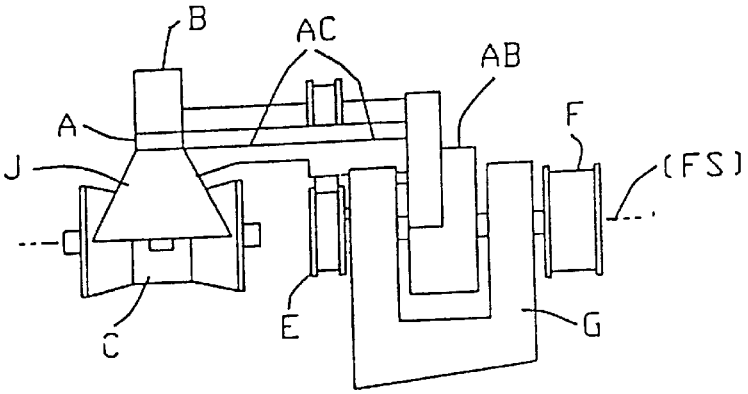
Figure 5:
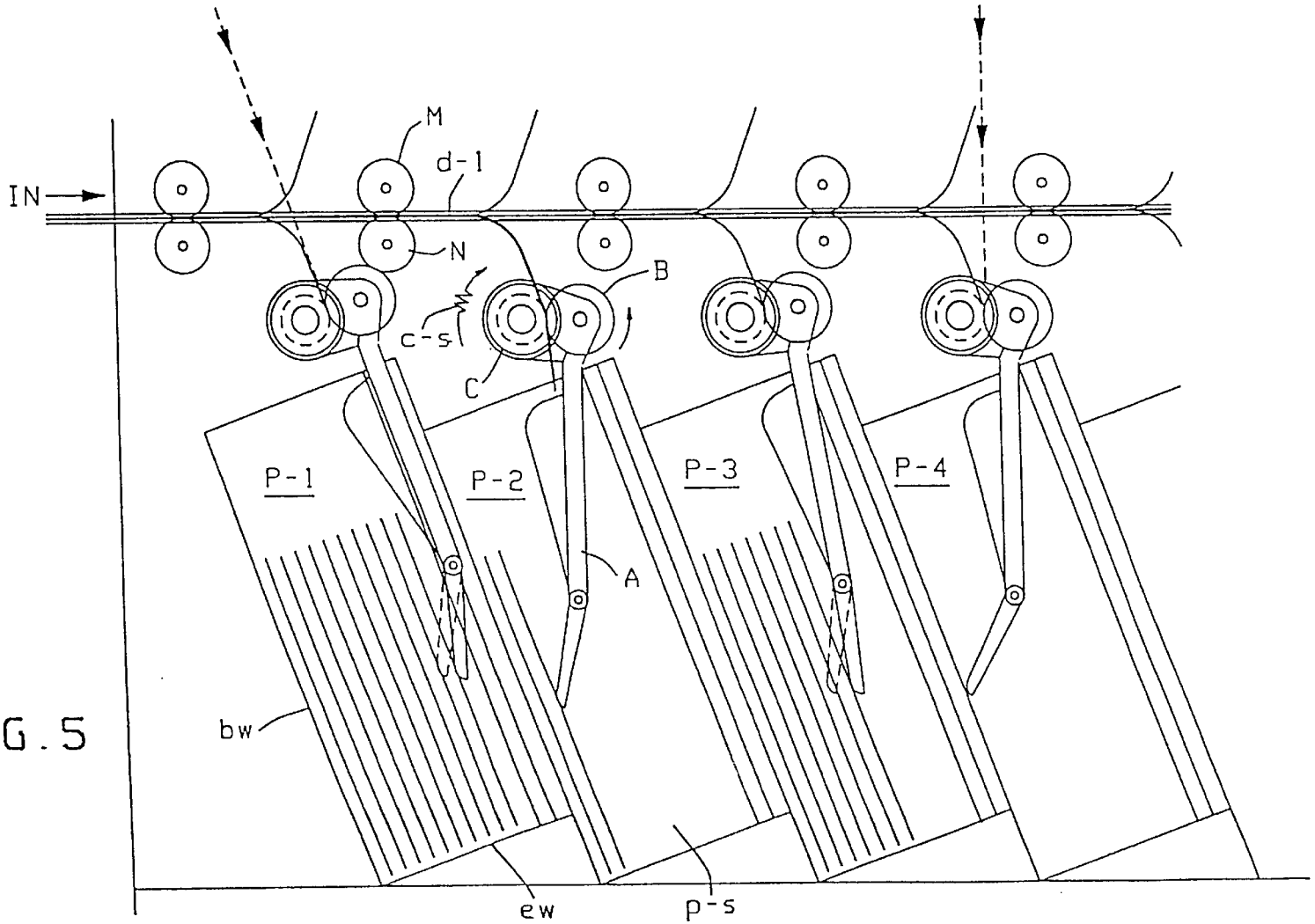
FIG. 5 shows, in enlarged plan schematic view, a set of stackers like that in FIGS. 2–4, each for a respective sort pocket.

Articulated arm tip "J" pivots freely about a pin "K" on the end of arm "A" and is spring-loaded to be urged clockwise (as seen in FIGS. 1, 3, 5: J-S; also see arrow FIG. 4C) and to resiliently aim the leading-edge of injected documents down into its pocket, while resiliently pressing lightly down on the top of the stack.

A wave spring "H" is mounted to arm "A" and acts to resiliently depress the trailing-edge of such injected-documents, while freely allowing their leading-edge to pass unaffected.

Drive pulley "F" is belt-driven off a main stacker transport drive (not detailed). The pulley ratios of the system will, preferably, be selected to drive pulley "B" at a faster surface velocity (e.g., here 20 to 30 inches per second faster) than the main transport (which acts along IN direction, FIG. 1). The actual velocity should be determined by testing, as known in the art; e.g., matching system inertias, document types and sizes, and spring forces and rates.

Figure 4A:
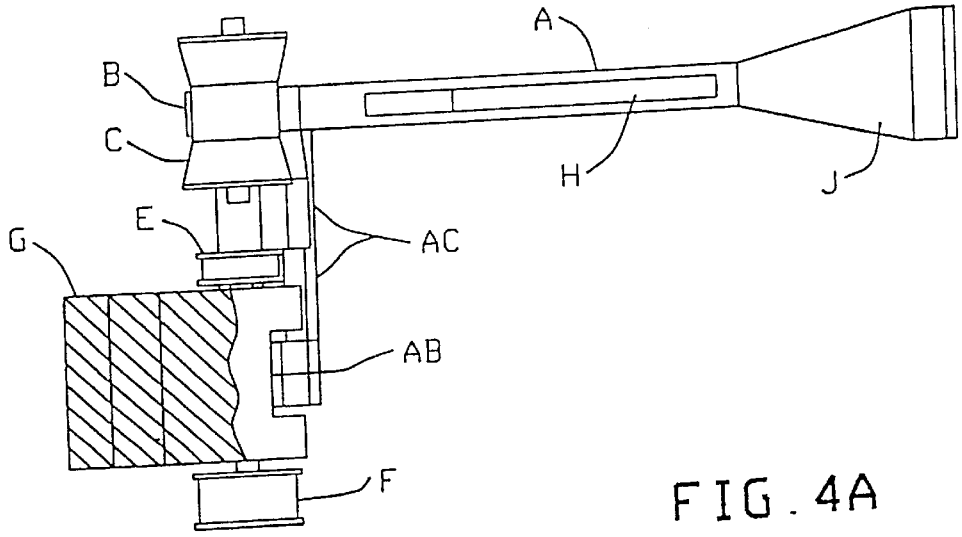
FIG. 4 shows the stacker of FIGS. 2, 3 in side elevation (FIG. 4A), in isometric perspective (FIG. 4B), in plan view (FIG. 4C); in front elevation (FIG. 4D)
Figure 4B:
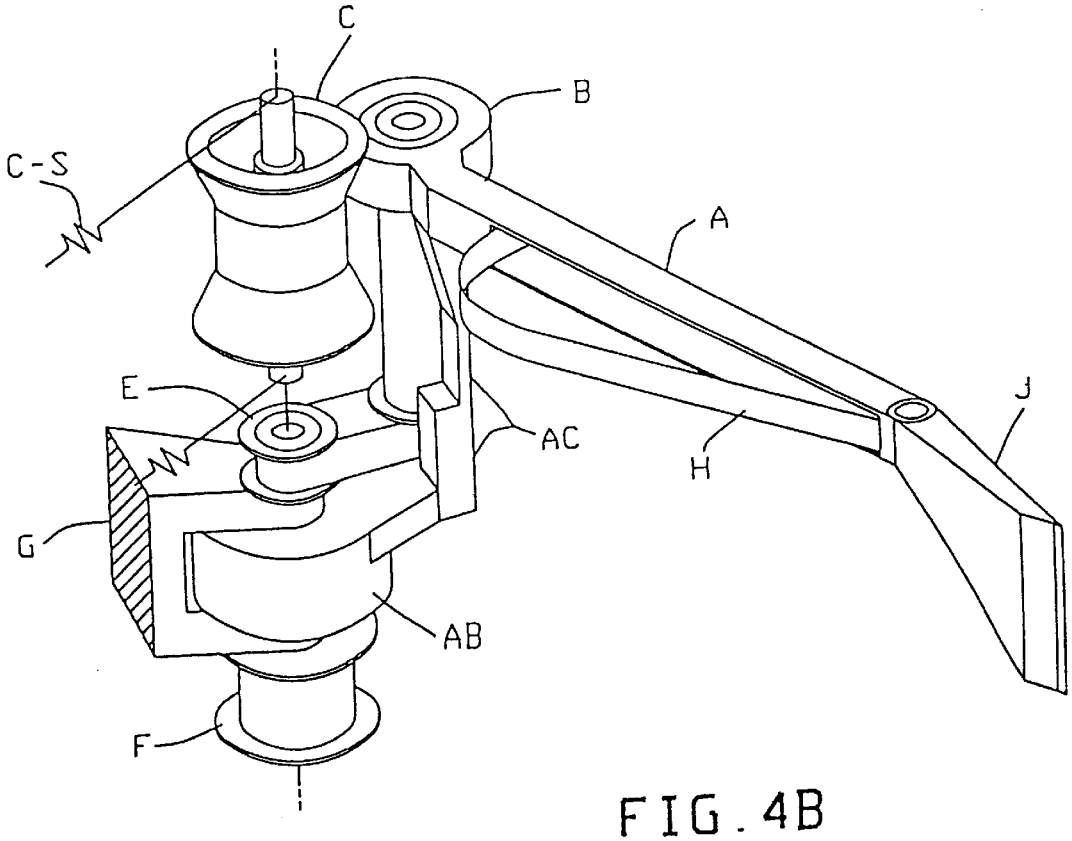
Figure 3A:
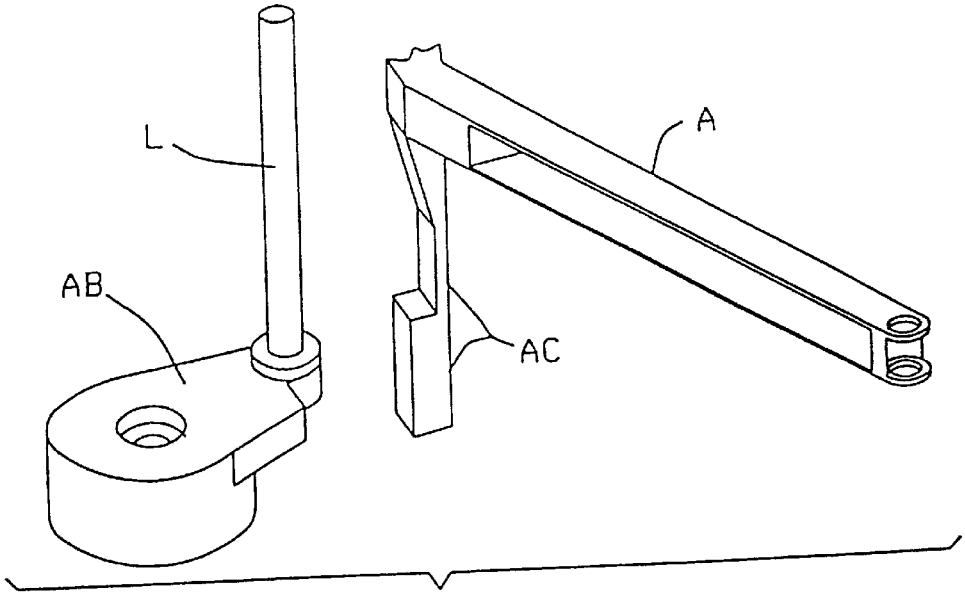

FIG. 3 shows an exploded elevation of elements of this assembly, with elements cut-away in FIG. 3A; while FIG. 4A shows a side view thereof (and front elevation in FIG. 4D), with FIG. 4B showing an isometric perspective and FIG. 4C a plan view.

FIG. 5 shows several stacker pockets (P-1, etc.), each with a respective inject-guide assembly AA: e.g. see arm A in the "full"-position (P-1) in the "empty" position (P-4), in the "almost-empty" position (P-2) and in the "partial full" (P-3) position. A sample document d-1 is shown entering "almost empty" pocket P-2 in FIG. 5. The trailing portion of document d-1 can be seen still engaged by a main transport roller pair, "M", "N", at the same time that its leading portions are engaged by rollers "B", "C" for injection into pocket P-2.

Since rollers "B", "C" are trying to drive document d-1 (into P-2) faster than rollers "M", "N", then d-1 will act as a slight "drag", rotating B counter-clockwise (see arrow). And, since the rest of arm assembly AA (including block AB and arm A) is coupled to rotate with B, then they too will rotate counter-clockwise (in plan view—see direction of reaction arrow)—, to thereby clear a path for the incoming document and throw A, J toward the "full-pocket" extreme, then let A, J fall back (clockwise, being spring-urged by A-S) until J contacts the top document in this pocket. (e.g. in P-2, it falls onto d-1 after d-1 is inserted into P-2). Here, it will be understood that rollers B, C are thereby positioned to aim document d-1 toward its ultimate position in P-2 (e.g. note "aim-paths" in FIG. 5 for pockets P-1, P-4).

FIG. 1 is a plan view of a 12-pocket Unisys DP500 check-stacker module, with each pocket fitted with a document-inject/reaction-guide arm assembly AA as per the above described embodiment. This identical type of assembly will accommodate all pockets, front and rear. This novel (stacker module) design will provide higher document capacity than for present conventional "large capacity" units (e.g., for the Unisys DP1800 Imaging Stacker); yet it keeps within the "footprint" of present "low capacity" units (e.g., the Unisys DP500 standard stacker). Further, it retains the short-document-handling capability (e.g. 4.5") of "standard" stacker-means. It is also simpler and "quieter", with a relatively few simple parts needed.

Functional description (e.g., see FIGS. 1–5):

The mechanism that aims the document (e.g. d-1, FIG. 5) includes inject-drive roller B placed at the pocket entry. Inject roller B is mounted on the pocket's inject-guide mechanism AA (including assembly AB, AC, arm A) which is arranged to pivot on shaft FS (i.e., pivots about the centerline of columnating idler roller C versus counter-urge of spring A-S, along with assembly A, AC, AB). Arm A is designed such that the "aim-line", (or tangent at the intersection of the idler C and drive roller B; this defining the inject-path (inject-aim-path) of the document into a pocket) is generally parallel to the length of arm A, and will shift in accordance with how full its pocket is. For instance, note, in FIG. 5, the aim-path for "Full" pocket P-1 versus that for "Empty" pocket P-4; also note spring-reaction arrows.

Arm A will be seen to be pivoted, as each document enters, about shaft FS (e.g. from an "empty-pocket" position, as for pockets P-2, P-4 in FIG. 5), to a "full-pocket" position (e.g., as for pocket P-1). Thus, as a pocket fills, this tangent ("aim line") is shifted to the position required by the next document, since arm A, (tip J) falls back to rest on the stack top. As successive documents enter a pocket, the "rest"-position of arm A (and roller B) is thus indexed back (versus spring) by the thickness of the document so the "aim-point" for the next document is shifted toward this next document's ultimate position in the pocket.

Roller B runs at a higher (surface) velocity than the main transport; and—as each document enters, this speed differential is used to swing B, (about C) and carry arm A back, to allow the document a free path to the back of the pocket. Roller spacing (B/C vs. M/N) is such that an injected document will still be driven by the (lower-speed) main-transport roller pair (e.g., M/N), when its leading edge is engaged by inject rollers B,C.

Since the main-transport rollers M, N, are driving the document at the lower speed, the higher-speed rollers B, C mounted on arm assembly AA will "try to climb the document," causing assembly AA (including block AB, and arm A) to pivot in the reaction-direction (arrows in P-2, FIG. 5) and clear a path (i.e., shift back in the pocket) for the incoming document. A return spring (AS in FIG. 3) then returns arm A until tip J lightly contacts the top document, thus placing arm A in position, to aim the next incoming document toward the stack-top.

The inertia of arm mechanism AA and the spring force are balanced to control how far, and how fast, the arm pivots back, and how rapidly it returns to depress the document stack (via tip J). The initial spring force is operator-adjustable (as known in the art) to allow tuning of each individual pocket to match the contemplated document size, weight and condition for that pocket.

The two-piece spring loaded, articulated arm A changes its contact point on the pocketed documents as the pocket fills up. This eliminates the effect of the tip J (on arm A) moving toward the leading edge of the documents as the pocket fills up, while also automatically shifting the contact point "towards the trailing edge as the pocket fills up. It also helps to hold the trailing edge away from the leading edge of the next incoming document.

Tip J of arm A is designed to act as an "inch worm" as the arm returns after a document is pocketed. This serves to help ensure that a document will reach the end (back wall, ew opposite roller B. see FIG. 5) of the pocket.

Wave spring H on arm A will help ensure a clear path for the incoming document. This spring is light enough so the energy of the incoming document will deflect the spring out of the way without essentially deflecting the document. Arm A also preferably carries a magnet assembly to actuate a "Hall effect" switch and so signal "full pocket".

The pockets have a "sloping floor" P-S (sloping "down" from full-side to empty-side, to help gravity-urge documents "down"-in a pocket, along with tip J against each pocket's "back-wall" bw [against which first-in document rests, e.g., see FIG. 5). And floor P-S "leans away" from the entrance zone to cause the document stack to lean (fall) away from incoming documents (under gravity, as workers will realize) toward bw.

The foregoing (and other, like) "stacker" embodiments will be seen as advantageously minimizing cost, assembly time, noise, etc., and as better accommodating various document sizes, while quickly reacting and steering successive documents to an optimal position in a pocket.

Conclusion

It will be understood that the preferred embodiments described herein are only exemplary, and that the invention is capable of many modifications and variations in construction, arrangement and use without departing from the spirit of the invention.

Since modifications of the invention are possible, for example the means and methods disclosed herein are also applicable to the sort-pockets of other sort/stack arrangements, as well as to other related stacking arrays; and it will be understood that the present invention is also applicable for enhancing other related sheet-advance arrangements (e.g., document sorters, mail sorters, copiers, page feeders for printers, punch card sorters, envelope stuffing machines, money feeders and transports in automatic teller machines).

Examples given above of other possible variations of this invention are merely illustrative. Accordingly, the present invention is to be considered as including all possible modifications and variations within the scope of the invention as defined by and set forth in the appended claims.

What is claimed is:

1. A method of stacking sheets in a sheet processing arrangement for transporting sheets serially at a prescribed nominal speed along a given track, toward one or several destination pockets, each with associated diverter means disposed thereat, this method comprising:

disposing conveyer means at the pocket entry of each pocket so as to guide a so-diverted sheet into its pocket; providing inject means to accelerate and drive the sheet faster than said nominal speed; and providing associated arm means adapted to guide a so-injected sheet toward its position in the stack in said pocket; while making said inject means and said arm means to throw said arm means away from the stack each time a sheet is entering the pocket and to return under the urging of associated spring means.

2. The method of claim 1, wherein said sheets are made to comprise checks or related like unit record documents.

3. The method of claim 2, wherein each said guide means is made to include arm means with spring-loaded, stack-contacting tip means rotatably disposed at its distal end.

4. The method of claim 3, wherein each said arm means is also made to include wave-guide spring means for depressing the trailing edge of each said unit record.

5. The method of claim 3, wherein each said guide means is also made to include roll means mounted on unitary block means, with said arm means.

6. The method of claim 5, wherein said roll means is made to include drive-roll means rotatably mounted on said block means.

7. The method of claim 6, including mounting each said block means rotatably on spindle means.

8. The method of claim 7, including mounting idle-roll means rotatably on said spindle means and spring-urging it against said drive-roll means to grip an incoming record.

9. The method of claim 8, wherein said spindle means is made to be conjunctively rotated by the main transport means and is also arranged and coupled to rotate said drive-roll means to so accelerate each incoming record.

10. In a sheet processing arrangement for transporting sheets at a prescribed nominal speed along a given transport track, with one or several pockets therealong and associated diverter means disposed therealong in each pocket, the combination therewith, in each pocket, of:

inject-conveyer means adapted to urge a so-diverted sheet into its pocket and comprising inject roll means to accelerate and drive the sheet faster than said nominal speed; and associated guide means adapted to guide a so-injected sheet toward its position in the stack in said pocket; and wherein each said inject conveyer means and each said guide means are coupled to throw the said guide means away from the stack each time a sheet is entering the subject pocket, and wherein return means is also provided to return the said guide means after such a throw.

11. The invention of claim 10, wherein said sheets comprise checks on like unit record documents.

12. The invention of claim 11, wherein each said guide means includes arm means with spring-loaded stack-contacting tip means rotatably disposed as its distal end.

13. The invention of claim 12, wherein each arm means also includes wave-guide spring means for depressing the trailing edge of each said sheet.

14. The invention of claim 13, wherein each said arm means and roll means are both mounted on unitary block means.

15. The invention of claim 14, wherein said roll means includes drive roll means rotatably mounted on said block means.

16. The invention of claim 15, wherein said block means is mounted rotatably on spindle means.

17. The invention of claim 16, wherein idler roll means is also mounted rotatably on said spindle means and is spring-urged against said drive roll means to grip an incoming sheet.

18. The invention of claim 17, wherein said spindle means is conjunctively rotated by the main transport means and is also arranged and coupled to rotate said roll means to so accelerate each incoming sheet.

19. A sheet processing arrangement for transporting sheets at a prescribed nominal speed along a given track, toward one or several pockets, each with associated diverter means disposed thereat, each pocket including:

conveyer means disposed at the pocket entry and adapted to drive a so-diverted sheet into its pocket, and comprising inject roll means to accelerate and drive the sheet faster than said nominal speed; plus guide means adapted to guide a so-injected sheet toward its positioning the stack in said pocket, and wherein said guide means comprises inject-means coupled to said guide means to throw said guide means away from the stack.

20. The invention of claim 19, wherein said sheets comprise like unit records.

21. The invention of claim 20, wherein each said guide means includes arm means with spring-loaded, stack-contacting tip means rotatably disposed at its distal end.

22. The invention of claim 21, wherein each said arm means also includes wave-guide spring means for depressing the trailing edge of each said unit record.

23. The invention of claim 22, wherein each said arm means and roll means are both mounted on unitary block means.

24. The invention of claim 23, wherein said roll means includes drive-roll means rotatably mounted on said block means.

25. The invention of claim 24, wherein each said arm means is operator-adjustable and coupled to return spring means so urging it to rotate back toward said stack.

26. The invention of claim 25, wherein said block means is mounted rotatably on spindle means.

27. The invention of claim 26, wherein idle-roll means is also mounted totatably on said spindle means and is spring-urged against said drive-roll means to grip an incoming record.

28. The invention of claim 27, wherein said spindle means is conjunctively rotated by the main transport means and is also arranged and coupled to rotate said drive-roll means to so accelerate each incoming record.

* * * * *